US009831544B2

(12) United States Patent
Choi et al.

(10) Patent No.: US 9,831,544 B2
(45) Date of Patent: Nov. 28, 2017

(54) HUMAN BODY WEARABLE ANTENNA HAVING DUAL BANDWIDTH

(71) Applicant: INDUSTRY-UNIVERSITY COOPERATION FOUNDATION HANYANG UNIVERSITY, Seoul (KR)

(72) Inventors: Jae-Hoon Choi, Seoul (KR); Kyeol Kwon, Seoul (KR); Jae-geun Ha, Seoul (KR); Soon-Yong Lee, Seoul (KR)

(73) Assignee: INDUSTRY-UNIVERSITY COOPERATION FOUNDATION HANYANG UNIVERSITY, Seoul (KR)

( * ) Notice: Subject to any disclaimer, the term of this patent is extended or adjusted under 35 U.S.C. 154(b) by 124 days.

(21) Appl. No.: 14/387,828

(22) PCT Filed: Mar. 22, 2013

(86) PCT No.: PCT/KR2013/002417
§ 371 (c)(1),
(2) Date: Sep. 24, 2014

(87) PCT Pub. No.: WO2013/147470
PCT Pub. Date: Oct. 3, 2013

(65) Prior Publication Data

US 2015/0048981 A1 Feb. 19, 2015

(30) Foreign Application Priority Data

Mar. 26, 2012 (KR) ..... 10-2012-0030485
May 22, 2012 (KR) ..... 10-2012-0054392

(51) Int. Cl.
*H01Q 1/12* (2006.01)
*H01Q 1/27* (2006.01)
(Continued)

(52) U.S. Cl.
CPC ..... *H01Q 1/273* (2013.01); *H01Q 5/364* (2015.01); *H01Q 9/0407* (2013.01)

(58) Field of Classification Search
CPC ..... H01Q 21/0006; H01Q 21/0075; H01Q 21/0087
(Continued)

(56) References Cited

U.S. PATENT DOCUMENTS 5,626,630 A * 5/1997 Markowitz ..... A61B 5/0031 128/903
2011/0050505 A1* 3/2011 Lim ..... H01Q 19/005 343/700 MS
2011/0241948 A1* 10/2011 Bevelacqua ..... H01Q 1/243 343/702

FOREIGN PATENT DOCUMENTS

JP 2009-106307 A 5/2009
KR 10-2011-0011849 A 2/2011
(Continued)

OTHER PUBLICATIONS

International Search Report for PCT/KR2013/002417 filed on Mar. 22, 2013.

*Primary Examiner* — Hoang Nguyen
*Assistant Examiner* — Jae Kim

(57) ABSTRACT

Disclosed is a human body wearable dual band antenna. The disclosed human body wearable antenna comprises: a substrate; a zeroth-order resonance antenna formed on the bottom of the substrate, for receiving a signal from a wireless device which is implanted in a human body; and a micro strip antenna formed on the top of the substrate, for transmitting the signal to a wireless device which is external to the human body. The dual band human body wearable antenna according to the present invention can relay com-
(Continued)

munications between the wireless device which is implanted in the human body and the wireless device which is external to the human body.

8 Claims, 5 Drawing Sheets

(51) Int. Cl.
*H01Q 9/04* (2006.01)
*H01Q 5/364* (2015.01)

(58) Field of Classification Search
USPC ..... 343/718, 876, 700 MS, 850
See application file for complete search history.

(56) References Cited

FOREIGN PATENT DOCUMENTS

| | | | |
|---|---|---|---|
| KR | 10-1021495 | B1 | 3/2011 |
| KR | 10-2011-0060389 | A | 6/2011 |

* cited by examiner (a) Radiation Pattern at 403.5 MHz (b) Radiation Pattern at 2450 MHz (a) SAR Distribution at 403.5 MHz (b) SAR Distribution at 2450 MHz

HUMAN BODY WEARABLE ANTENNA HAVING DUAL BANDWIDTH

CROSS-REFERENCE TO RELATED APPLICATIONS

This application is a National Phase Application of PCT International Application No. PCT/KR2013/002417, which was filed on Mar. 22, 2013, and which claims priority from Korean Patent Application No. 10-2012-0030485 filed with the Korean Intellectual Property Office on Mar. 26, 2012, and Korean Patent Application No. 10-2012-0054392 filed with the Korean Intellectual Property Office on May 22, 2012. The disclosures of the above patent applications are incorporated herein by reference in their entirety.

BACKGROUND

1. Technical Field

Embodiments of the present invention relate to a dual band wearable antenna, more particularly to a wearable antenna having a dual band that relays communications between a wireless device implanted in the body and a wireless device outside the body.

2. Description of the Related Art

With the growing interest in the wireless body area network (WBAN), wireless RF communication for use near a human body or centering on a human body is increasing in importance. Such wireless RF communication can be combined not only with the WBAN, in which a device may be mounted on the human body such as by implanting the device into the body or wearing the device on the body to form a node with the human body, but also with wireless sensor networks, wireless personal area networks, and the like, to expand its application to various fields.

In the application fields mentioned above, various devices are being used for monitoring vital signs by way of medical equipment implanted inside a human body. Such medical equipment may operate by checking, for example, the heart rate, blood pressure, etc., and transmitting the results to an external device, and may employ an antenna for transmitting data wirelessly.

When a conventional body-implanted wireless device having an antenna communicates directly with a wireless device that is outside the body, the high dielectric rate of the human body may cause changes in the return loss properties of the antenna, resulting in problems of degraded performance or unwanted operation in actual practice. Moreover, other restraints such as low radiation efficiency, low power consumption, limited radiation power for avoiding interference with nearby medical devices, and the like, may impose limits in implementing direct communication with an external wireless device.

SUMMARY

To resolve the problems in the related art described above, an aspect of the present invention proposes a dual-band wearable antenna that relays communications between a wireless device implanted in the body and a wireless device outside the body.

Other objectives of the present invention can be derived by those of ordinary skill in the art from the embodiments described below.

To achieve the objective above, an embodiment of the invention provides a wearable antenna that includes: a substrate; a zeroth order resonance antenna, which is formed on a lower part of the substrate, and which is configured to receive a signal from a wireless device implanted in a body; and a microstrip antenna, which is formed on an upper part of the substrate, and which is configured to transmit the signal to a wireless device external to the body.

The zeroth order resonance antenna can include a radiator, which may be formed on a lower part of the substrate, and a ground plane, which may be formed on a lower part of the substrate surrounding the radiator.

The wearable antenna can further include a short-circuit column that is inserted in a via hole penetrating the upper part and the lower part of the substrate and is electrically joined with a first feed line of the microstrip antenna formed on the upper part of the substrate and with a second feed line of the zeroth order resonance antenna formed on the lower part of the substrate.

The zeroth order resonance antenna can include: a radiator formed on a lower part of the substrate; a ground plane formed on a lower part of the substrate; and at least one inductor joined with the radiator and the ground plane.

The second feed line may preferably be a CPW feed line.

The radiator can be separated by a particular distance from the second feed line such that a gap is formed between the radiator and the second feed line.

The inductor may preferably be a chip inductor.

The wearable antenna can be attached to a band made from an elastic material.

The substrate can be a flexible substrate.

The zeroth resonance antenna can have a radiation pattern with a directivity oriented towards the inside of the body in a MICS band, and the microstrip antenna can have a radiation pattern with a directivity oriented towards the outside of the body in an ISM band.

Another embodiment of the invention provides a wearable antenna that includes: a substrate; a zeroth order resonance antenna formed on a lower part of the substrate; a microstrip antenna formed on an upper part of the substrate; and a short-circuit column that is inserted in a via hole penetrating the upper part and the lower part of the substrate and is electrically joined with a feed line of the zeroth order resonance antenna formed on the lower part of the substrate and with a feed line of the microstrip antenna formed on the upper part of the substrate.

Still another embodiment of the invention provides a wearable antenna that includes: a substrate; a zeroth order resonance antenna formed on a lower part of the substrate; and a microstrip antenna formed on an upper part of the substrate, where the zeroth order resonance antenna includes a radiator, which may be formed on a lower part of the substrate, and a ground plane, which may be formed surrounding the radiator.

A dual band wearable antenna according to an embodiment of the invention can relay communications between a wireless device implanted in the body and a wireless device outside the body.

Additional aspects and advantages of the present invention will be set forth in part in the description which follows, and in part will be obvious from the description, or may be learned by practice of the invention.

DETAILED DESCRIPTION

Figure 1:
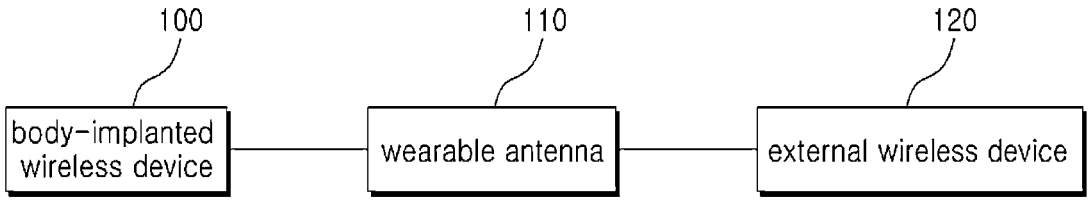
FIG. 1 illustrates an example of a wearable relay system according to an embodiment of the present invention.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, like reference numerals are used for like elements.

Certain embodiments of the invention are described below in more detail with reference to the accompanying drawings.

An aspect of the present invention proposes a wearable antenna that collects biosignals, etc., from a wireless device implanted in the body and transmits the collected biosignals to a wireless device outside the body, in order to resolve the problem of performance degradation that may occur when a body-implanted wireless device transmits signals to an external wireless device due to the high dielectric rate of the human body.

FIG. 1 illustrates an example of a wearable relay system according to an embodiment of the present invention.

Referring to FIG. 1, the wearable relay system can include a body-implanted wireless device 100, a wearable antenna 110, and an external wireless device 120 that is external to the body.

The body-implanted wireless device 100 may be implanted inside the body to measure biosignals such as heart rate, blood pressure, etc., and transmit them to an external device.

The wearable antenna 110 may receive the signals that are transmitted from the body-implanted wireless device 100 and transmit them to the external wireless device 120 that is outside the body. In other words, the wearable antenna 110 may serve to relay communications between the body-implanted wireless device 100 and the external wireless device 120.

The external wireless device 120 outside the body may analyze the transmitted biosignals to monitor the health of the patient.

The body-implanted wireless device 100 may generally operate in the MICS (medical implantable communication service) band (402 MHz-405 MHz), while the external wireless device 120 may operate at the ISM (industrial scientific and medical) band (2.4 GHz-2.485 GHz).

Therefore, in order to relay communications between the body-implanted wireless device 100 and the external wireless device 120, a wearable antenna 110 based on an embodiment of the invention can be implemented as an antenna having a dual band, so as to operate in both the ISM band and the MICS band.

According to an embodiment of the invention, the upper part of the wearable antenna 110 can be implemented as a microstrip antenna that has a radiation pattern oriented towards the outside of the body in the ISM band, and the lower part can be implemented as zeroth order resonance (epsilon negative zeroth order resonance, ENG ZOR) antenna that has a radiation pattern oriented towards the inside of the body in the MICS band.

Here, a microstrip antenna is an antenna that is structured to have a feed line arranged on the upper part of the substrate and a ground plane arranged on the lower part of the substrate, with signals transmitted between the feed line and the ground plane.

Thus, in an embodiment of the invention that implements a microstrip antenna and a zeroth order resonance antenna on one substrate simultaneously, the zeroth order resonance antenna can be implemented by using the ground plane arranged on the lower part of the substrate and a radiator arranged in the same plane as the ground plane.

That is, the wearable antenna 110 based on an embodiment of the invention may implement both the microstrip antenna and the zeroth resonance antenna by using one ground plane.

The composition of the wearable antenna 110 is described below in more detail with reference to FIG. 2 and FIG. 3.

Figure 2:
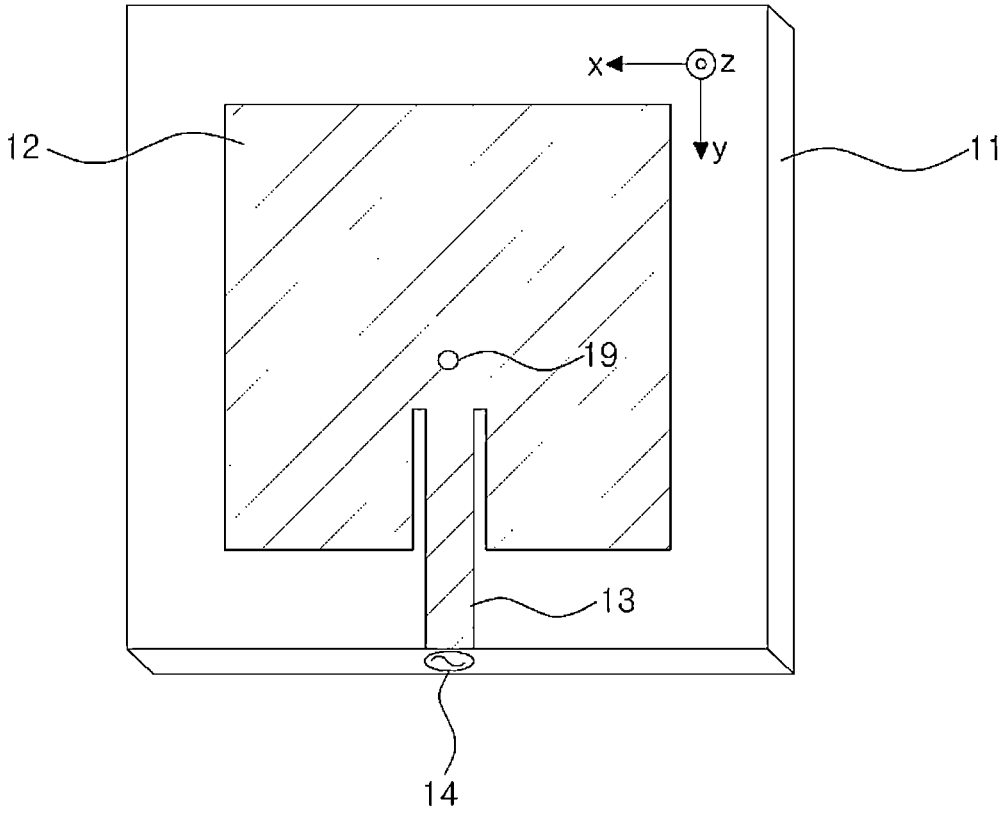
FIG. 2 is a top view of a wearable antenna according to an embodiment of the present invention.
Figure 3:
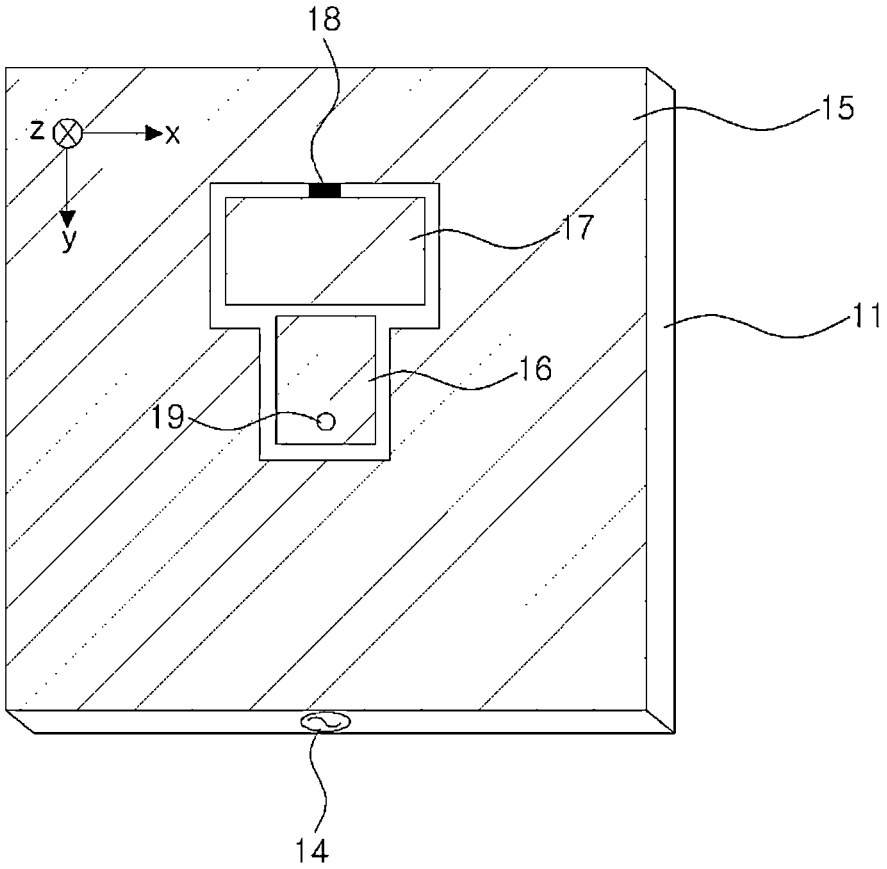
FIG. 3 is a bottom view of a wearable antenna according to an embodiment of the present invention.

FIG. 2 is a top view of a wearable antenna according to an embodiment of the present invention, and FIG. 3 is a bottom view of a wearable antenna according to an embodiment of the present invention.

A dielectric substrate 11 may provide a dielectric rate for radiating RF signals and may serve as the main body on which the antenna may be joined. The upper structure of FIG. 2 and the lower structure of FIG. 3 may be formed on the dielectric substrate 11, joined onto the dielectric substrate 11 by using any of various techniques for joining metal. For instance, the structures of FIG. 2 and FIG. 3 can be formed on the dielectric substrate 11 by using a technique such as etching, printing, etc.

According to an embodiment of the present invention, the dielectric substrate 11 for the invention can have a relative permittivity of 4.4 and a thickness of 1.6 mm, and a FR-4 substrate can be used. Of course, the thickness and material of the substrate can differ according to the operating frequency band. By using the upper and lower surfaces of an inexpensive FR-4 substrate, a simple antenna can be designed that is suitable for a wearable system of a single-plane structure, and the cost of manufacturing can be reduced.

On the upper part of the dielectric substrate 11, a first radiator 12 and a first feed line 13 may be formed to implement a microstrip antenna.

Also, on the lower part of the dielectric substrate 11, a ground plane 15, a second feed line 16, a second radiator 17, and an inductor 18 may be formed to implement a zeroth order resonance antenna.

First, consider the composition on the upper part of the dielectric substrate 11 for implementing the microstrip antenna.

The first feed line 13 may be electrically joined to a feed part 14 and may provide a feed signal to the first radiator 12. The first feed line 13 can be made of a conductive material and, for example, can be joined with a connector. When the first feed line 13 is joined with a connector, the inner core of the connector by which the feed signal is provided may be joined with the first feed line 13.

The first radiator 12 can be separated from the first feed line 13 by a particular distance for an inset edge feed.

By way of the ground plane 15 formed on the lower part of the dielectric substrate 11, the signal of the microstrip antenna may be and transferred as a form of a field is induced between the first feed line 13 and the ground plane 15.

Since the ground plane 15 exists below the first radiator 12, the ground plane 15 may reduce the amount of electromagnetic waves radiated from the first radiator 12 towards the body, thus reducing the SAR (specific absorption rate), which represents the rate at which electromagnetic waves are absorbed by the human body.

According to an embodiment of the invention, the radiating frequency can be adjusted by the length and width of the first radiator 12. While FIG. 1 illustrates the first radiator 12 as having a "C"-letter shape, the form of the radiator can be changed as necessary.

The microstrip antenna based on an embodiment of the invention can be used in the ISM band to be capable of communicating with a system external to the body. In an embodiment of the invention, a first feed line having a width of 3 mm that is connected with the feed part 14 may be formed on a first radiator 12 having a length and width of 27.5 mm, so as to enable use of the microstrip antenna in the ISM band. Also, the gap between the first radiator 12 and the first feed line 13 may be set to have a length of 8.75 mm and a width of 7 mm, in order to implement an edge feed structure. Of course, the lengths and widths of the first radiator 12 and the first feed line 13 can be adjusted in correspondence to the operating frequency.

Next, consider the lower part of the of the dielectric substrate 11 that implements the zeroth order resonance antenna.

The second feed line 16 formed on the lower part of the dielectric substrate 11 may be electrically joined with a short-circuit column 19 that is inserted through a via hole, which penetrates the upper part and lower part of the dielectric substrate 11, and provides feed signals to the second radiator 17. That is, the feed signals provided through one feed part 14 may be provided to the second feed line 16 through the short-circuit column 19, which is electrically joined with the first feed line 13.

In other words, an embodiment of the invention provides the advantage of using a single feed part 14 to operate the microstrip antenna and the zeroth order resonance antenna simultaneously.

According to an embodiment of the invention, the second feed line 16 may be implemented as the feed line 16 of a CPW structure that includes a ground plane 15 formed near the second feed line 16 in the same plane. The feed line of a CPW structure, which may have a ground plane formed near the feed line in the same plane, may be a feed line for transmitting RF signals by generating an electric field between the feed line and the ground plane, and is mainly used in antennas having a flat structure.

The ground plane 15 may be electrically joined with a ground to provide a ground voltage. In an embodiment of the invention, the ground plane 15 can be arranged as a structure that surrounds the second feed line 16 and the second radiator 17.

The zeroth order resonance antenna illustrated in FIG. 3 has a CPW feeding structure, and thus the ground plane 15 may be separated from the second feed line 16 by a distance that allows coupling.

Thus, an embodiment of the invention provides the advantage of implementing a wearable antenna 110 in which the upper part of the dielectric substrate 11 can operate as a microstrip antenna and the lower part can operate as a zeroth order resonance antenna while using one ground plane 15.

The second radiator 17 may be fed by a gap feeding method, separated by a particular distance from the feed line 16 of the CPW structure. The radiating frequency can be adjusted by the length and width of the second radiator 17, and while FIG. 1 illustrates the second radiator 17 as having a rectangular shape, the form of the radiator can be changed as necessary.

The second radiator 17 and the ground plane 15 may be connected by the inductor 18. That is, the zeroth order resonance antenna based on an embodiment of the invention may implement zeroth order resonance having a negative dielectric rate by joining the inductor 18 between the second radiator 17 and the ground plane 15.

With the zeroth order resonance antenna based on an embodiment of the invention, the resonance frequency can be altered by adjusting the size of the inductor 18. Here, the inductor 18 may preferably be a chip inductor, and a structure having high inductance can be applied as necessary.

The zeroth order resonance antenna formed on the lower surface of the dielectric substrate 11 based on an embodiment of the invention can be used in the MICS band so as to be capable of collecting biometric information from a body-implanted device.

In an embodiment of the invention, the second feed line 16 was set to have a length of 8 mm and a width of 6 mm for use in the MISC band. Also, the second radiator 17 was set to have a length of 7 mm and a width of 14 mm, and the gap between the second feed line 16 and the radiator 17 was set to 0.2 mm. Of course, the lengths and widths of the second radiator 17 and the second feed line 16 can be adjusted in correspondence to the operating frequency.

With the microstrip antenna on the upper part of the dielectric substrate 11 that operates in the ISM band according to an embodiment of the invention, the return loss properties are not changed, even if the distance of the antenna from a surface of the body is decreased, due to the influence of the ground plane 15 formed on the lower part of the dielectric substrate 12, and a radiation pattern is formed oriented towards the outside of the body.

Also, with the zeroth order resonance antenna on the lower part of the dielectric substrate 11 that operates in the MISC band, radiation in directions oriented towards the outside of the body is suppressed by the influence of the microstrip antenna on the upper part, so that a radiation pattern is formed oriented towards the inside of the body, and due to the characteristics of zeroth order resonance, the return loss properties remain almost unchanged, even if the distance of the antenna from a surface of the body is decreased.

Therefore, an embodiment of the invention can provide radiation patterns that have directivity oriented towards the inside of the body in the MICS band and have directivity oriented towards the outside of the body in the ISM band, so that the impact of the human body, which has a high dielectric rate, on the performance of the antenna may be alleviated, and the reliability of communications improved.

In other words, the wearable antenna 110 can relay communications between a body-implanted wireless device 100 and an external wireless device 120 that is outside the body, thereby providing a solution for the problem of degradations in communication performance that would occur when a conventional body-implanted wireless device 100 communicates directly with an external wireless device 120 external to the body.

According to an embodiment of the invention, signals received from the body-implanted wireless device 100 via the zeroth order resonance antenna can be frequency-modulated by way of a separate signal-processing apparatus (not shown) and transmitted to the external wireless device 120 that is outside the body via the microstrip patch antenna.

According to an embodiment of the invention, the wearable antenna 110 can also be attached to a band made of an elastic material, so as to keep close contact in a flexible manner according to the curvature of the skin of the human body. In this case, a flexible substrate can be used for the dielectric substrate 11 so as to allow close contact.

Also, the wearable antenna 110 can be inserted in a piece of clothing worn by the body or can include a securing part (not shown) for securing onto the piece of clothing. It would be apparent to those skilled in the art that various embodiments can be conceived that allow the user to wear the wearable antenna 110 on the body in a stable manner.

Figure 4:
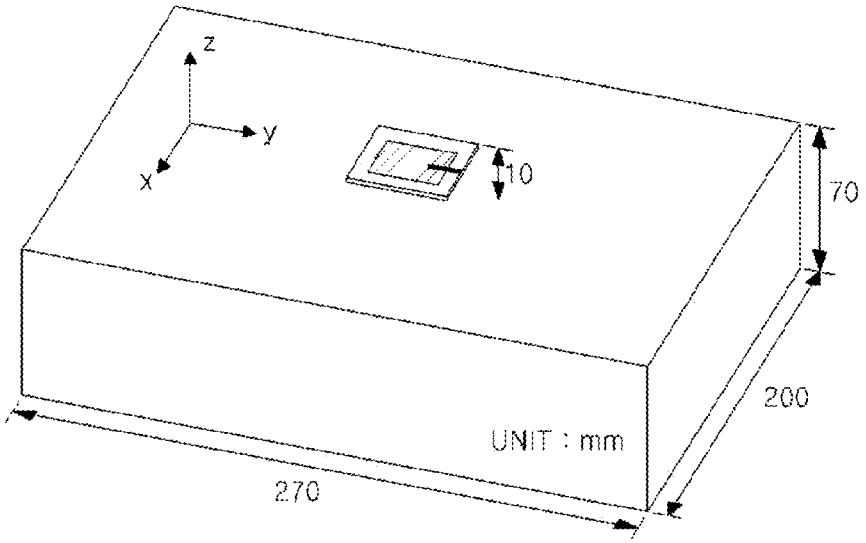
FIG. 4 illustrates the structure of an apparatus for testing a wearable antenna based on an embodiment of the present invention.

FIG. 4 illustrates the structure of an apparatus for testing a wearable antenna based on an embodiment of the present invention.

The performance of an antenna was measured using the semi-solid phantom of FIG. 4 that has a height of 70 mm, dimensions of 270 mm×200 mm, and a dielectric rate equivalent to the human body, with the antenna separated by 10 mm from the center of the surface of the phantom.

Figure 5:
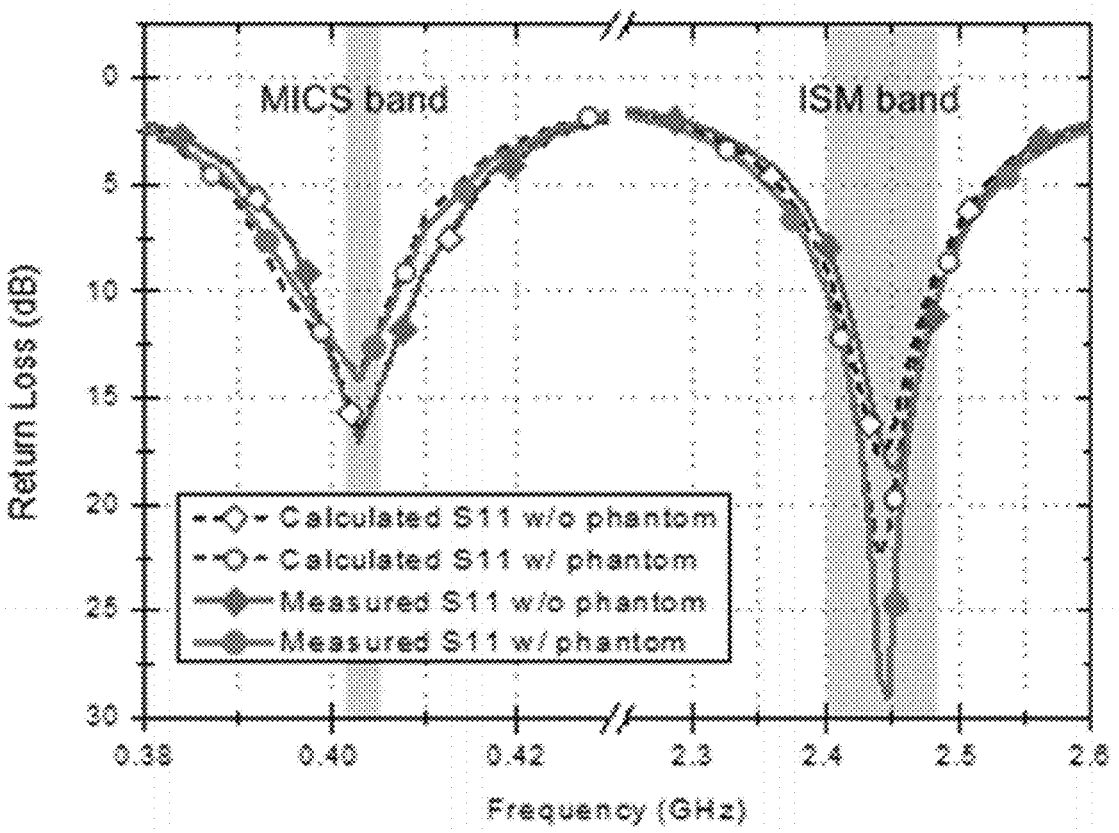
FIG. 5 shows return loss performance when a wearable antenna according to an embodiment of the present invention is positioned on a phantom and in the air.

FIG. 5 shows return loss performance when a wearable antenna according to an embodiment of the present invention is positioned on a phantom and in the air.

Referring to FIG. 5, it can be seen that the return loss properties of the wearable antenna 110 are very insensitive to the effect of the body in both the MICS band and the ISM band, even when the body is close to the wearable antenna 110.

Figure 6:
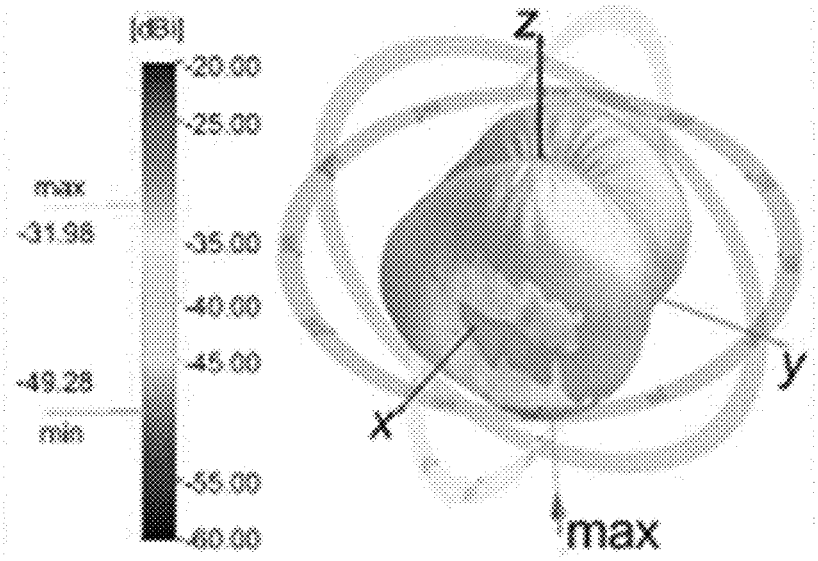
FIG. 6 shows radiation patterns of a wearable antenna according to an embodiment of the present invention at its operating frequencies.
Figure 6:
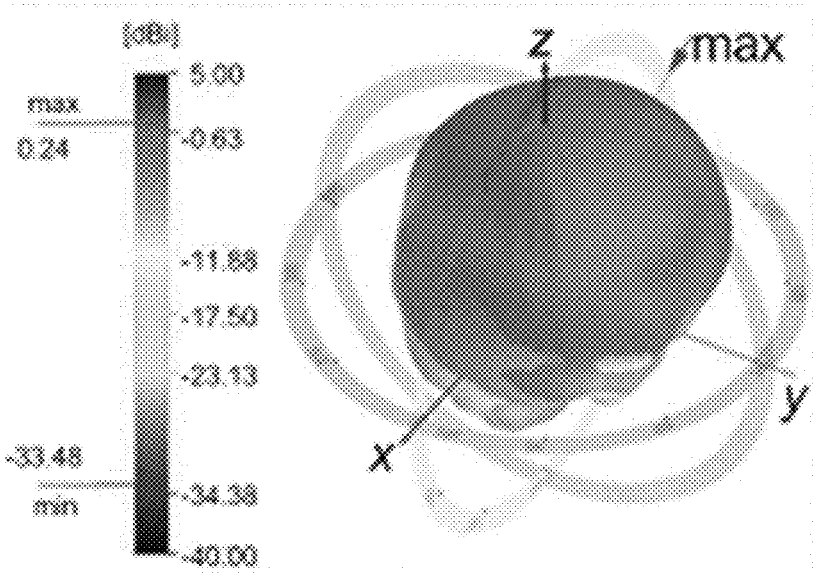

FIG. 6 shows the radiation patterns of a wearable antenna according to an embodiment of the present invention at its operating frequencies.

Referring to FIG. 6(*a*), it can be seen that the zeroth order resonance antenna implemented on the lower part of the wearable antenna 110 based on an embodiment of the invention has a radiation pattern having a directivity oriented towards the inside of the body at 403.5 MHz, for communicating with a wireless device that is implanted inside the body and is operating in the MICS band.

Referring to FIG. 6(*b*), it can be seen that the microstrip antenna implemented on the upper part of the wearable antenna 110 based on an embodiment of the invention has a radiation pattern having a directivity oriented towards the outside of the body at 2459 MHz, for communicating with an external wireless device 120 that is outside the body and is operating in the ISM band.

Figure 7:
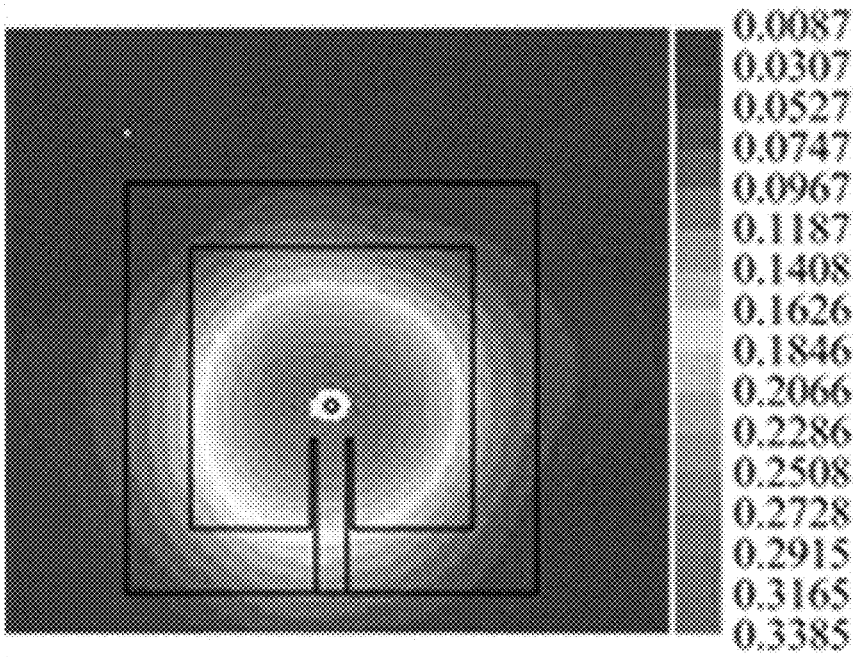
FIG. 7 shows average SAR values measured for a wearable antenna according to an embodiment of the present invention.
Figure 7:
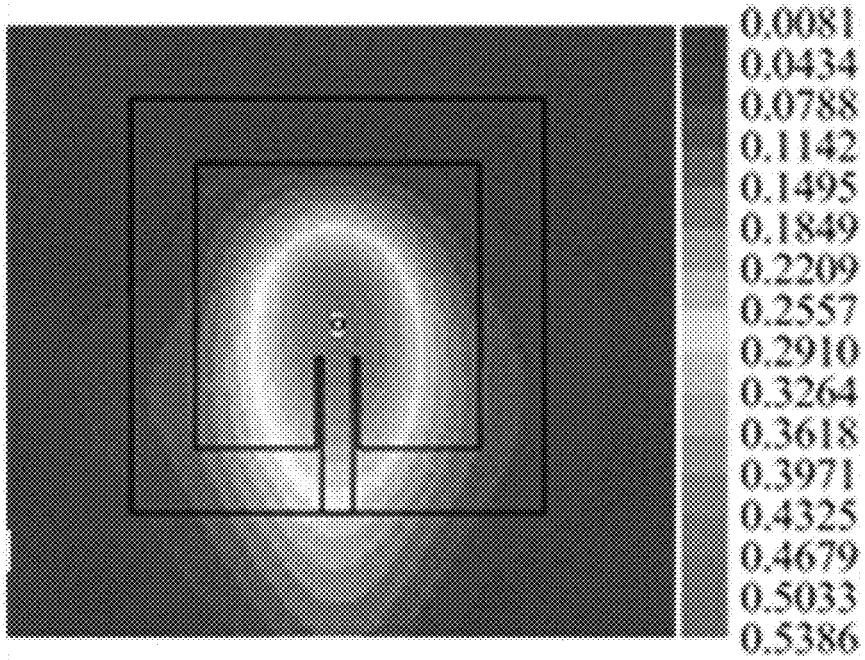

FIG. 7 shows average SAR values measured for a wearable antenna according to an embodiment of the present invention.

With the application of 250 mW, which is the input power used when measuring SAR for a typical mobile phone, 0.411 W/kg was measured at 403.5 MHz for the MICS band, as shown in FIG. 6(*a*), and 0.455 W/kg was measured at 2450 MHz for the ISM band, as shown in FIG. 6(*b*). These values are considerably lower than the 1.6 W/kg value set by the ANSI/IEEE standard.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

What is claimed is:

1. A wearable antenna comprising: a substrate;

a zeroth order resonance antenna formed on a lower part of the substrate, the zeroth order resonance antenna configured to receive a signal from a wireless device implanted in a body; and a microstrip antenna formed on an upper part of the substrate, the microstrip antenna configured to transmit the signal to a wireless device external to the body, wherein the microstrip antenna comprises a first radiator and a first feed line for providing feeding signal to the first radiator, wherein the microstrip antenna has a radiation pattern with a directivity oriented towards an outside of the body, wherein the first radiator is separated from the first feed line by a particular distance for an inset edge feed structure, wherein the zeroth order resonance antenna comprises a second radiator, a ground plane, and a second feed line for providing feeding signal to the second radiator, the second radiator formed on the lower part of the substrate, the ground plane formed on the lower part of the substrate surrounding the second radiator, wherein the zeroth order resonance antenna has a radiation pattern with a directivity oriented towards an inside of the body, wherein the second radiator has a rectangular shape and is separated by a particular distance from the second feed line such that a gap is formed between the second radiator and the second feed line, and wherein the wearable antenna further comprises a short-circuit column inserted in a via hole penetrating the upper part and the lower part of the substrate, the short-circuit column electrically joined with the first feed line of the microstrip antenna formed on the upper part of the substrate and with the second feed line of the zeroth order resonance antenna formed on the lower part of the substrate.

2. The wearable antenna of claim 1, wherein the first radiator has a "C"-letter shape.

3. The wearable antenna of claim 1, wherein the zeroth order resonance antenna further comprises at least one inductor joined with the second radiator and the ground plane.

4. The wearable antenna of claim 3, wherein the second feed line is a CPW feed line and the ground plane is separated from the second feed line by a distance to allow coupling.

5. The wearable antenna of claim 3, wherein the inductor is a chip inductor.

6. The wearable antenna of claim 1, wherein the wearable antenna is attached to a band made from an elastic material.

7. The wearable antenna of claim 1, wherein the substrate is a flexible substrate.

8. The wearable antenna of claim 1, wherein the first feed line is electrically joined to a single feed part which provides the feeding signal to the second feed line through the short-circuit column.

* * * * *